US010891882B1

(12) United States Patent
Baroughi et al.

(10) Patent No.: US 10,891,882 B1
(45) Date of Patent: Jan. 12, 2021

(54) TECHNIQUES FOR TESTING ELECTRICALLY CONFIGURABLE DIGITAL DISPLAYS, AND ASSOCIATED DISPLAY ARCHITECTURE

(71) Applicant: Apple Inc., Cupertino, CA (US)

(72) Inventors: Mahdi Farrokh Baroughi, Santa Clara, CA (US); Mohammad B. Vahid Far, San Jose, CA (US); Xiang Lu, Campbell, CA (US); Bo Yang, Santa Clara, CA (US); Derek K. Shaeffer, Redwood City, CA (US); Henry C. Jen, Los Altos, CA (US); Hopil Bae, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 358 days.

(21) Appl. No.: 15/910,886

(22) Filed: Mar. 2, 2018

Related U.S. Application Data

(63) Continuation of application No. 15/711,817, filed on Sep. 21, 2017, now abandoned.

(60) Provisional application No. 62/398,399, filed on Sep. 22, 2016.

(51) Int. Cl.
*G09G 3/00* (2006.01)
*G09G 3/36* (2006.01)

(52) U.S. Cl.
CPC ..... *G09G 3/006* (2013.01); *G09G 3/367* (2013.01); *G09G 2310/0275* (2013.01)

(58) Field of Classification Search
None
See application file for complete search history.

(56) References Cited

U.S. PATENT DOCUMENTS

2004/0201022 A1* 10/2004 Yamazaki ..... H01L 27/1277 257/72
2007/0080913 A1* 4/2007 Park ..... G09G 3/3648 345/87
2014/0240304 A1* 8/2014 In ..... G09G 3/3233 345/212
2017/0053577 A1* 2/2017 Cao ..... G09G 3/006
2018/0144687 A1* 5/2018 Lin ..... G09G 3/3258

* cited by examiner

*Primary Examiner* — Jas A Sanghera
(74) *Attorney, Agent, or Firm* — Fletcher Yoder P.C.

(57) ABSTRACT

The present techniques are capable of identifying and pinpointing defective microdrivers and/or row/column drivers either before or after any μLEDs have been placed on the display. Using the architectures described herein, test data may be delivered in a parallel fashion to the drivers from support circuitry, such as a timing controller and/or a main board, and outputs based on the test data may be similarly delivered back to the support circuitry do determine which drivers are defective. This yields access to the output of every microdriver and row drier, thus enabling the identification of specific defective elements.

28 Claims, 14 Drawing Sheets

TECHNIQUES FOR TESTING ELECTRICALLY CONFIGURABLE DIGITAL DISPLAYS, AND ASSOCIATED DISPLAY ARCHITECTURE

CROSS REFERENCE TO RELATED APPLICATIONS

This application is a continuation of U.S. application Ser. No. 15/711,817, filed Sep. 21, 2017, which claims the benefit of U.S. Provisional Application No. 62/398,399, filed on Sep. 22, 2016, the contents of which are herein expressly incorporated by reference for all purposes.

BACKGROUND

The present disclosure relates generally to techniques for testing a display and, more particularly, to techniques for testing an electrically configurable display panel.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Most modern electronic devices, such as computer monitors, televisions, vehicle infotainment systems, smart phones, and smart watches, utilize flat panel displays. Traditionally, most flat panel displays have employed liquid crystal display (LCD) technology. Although specific designs vary, LCDs typically include a layer of liquid crystal molecules disposed between two transparent electrodes and two polarizing filters. By controlling the voltage applied across the liquid crystal layer for each pixel, light can be allowed to pass through in varying amounts. Because the LCD pixels produce no light of their own, LCDs typically use a backlight, such as a fluorescent lamp or an array of light emitting diodes (LEDs) to produce a visible image. Advantageously, LCDs are relatively compact, inexpensive, easy to operate, and can be made in almost any size. However, disadvantageously, LCDs tend to have a limited viewing angle, relatively poor black levels because the liquid crystals cannot completely block all the light from passing through, uneven backlighting, and are relatively difficult to read in sunlight.

More recently, displays using organic light emitting diodes (OLED) have been replacing the more traditional flat panel displays. OLED displays use LEDs that include an emissive electroluminescent layer made from an organic compound that emits light in response to an electric current. Because an OLED display emits its own light and, thus, works without a backlight, it can display darker black levels and can be thinner and lighter than a comparable LCD. Disadvantageously, however, the organic materials used in OLEDs tend to degrade fairly quickly and, thus, have a typical lifetime of less than half of a comparable LCD. Furthermore, because the organic materials used to produce blue light degrade more quickly than the organic materials used to produce red and green light, the color balance of OLED displays typically shifts much more over time as compared to a comparable LCD.

In an effort to address some of the problems of LCD and OLED displays, micro LED (μLED) displays are an emerging flat panel display technology. μLED displays include arrays of microscopic arrays of LED that form individual pixel or subpixel elements. As compared to LCD and OLED technology, μLED displays offer greater contrast, faster response times and less energy consumption. Further, μLED displays are easier to read in direct sunlight and do not suffer from the shorter lifetimes of OLED displays. However, electrically configurable displays (such as μLED displays) use active matrixes of μLEDs, pixel drivers (commonly referred to as microdrivers), and arrays of row and column drivers all integrated on a routing backplane in a hybrid fashion. While this hybrid approach enables integration of state of the art technologies for μLEDs, microdrivers, and row and column drivers to yield a superior display technology, the approach relies on pick-and-place and bonding technologies that are prone to certain placement and bonding imperfections. The techniques disclosed herein are directed to addressing some of these concerns.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
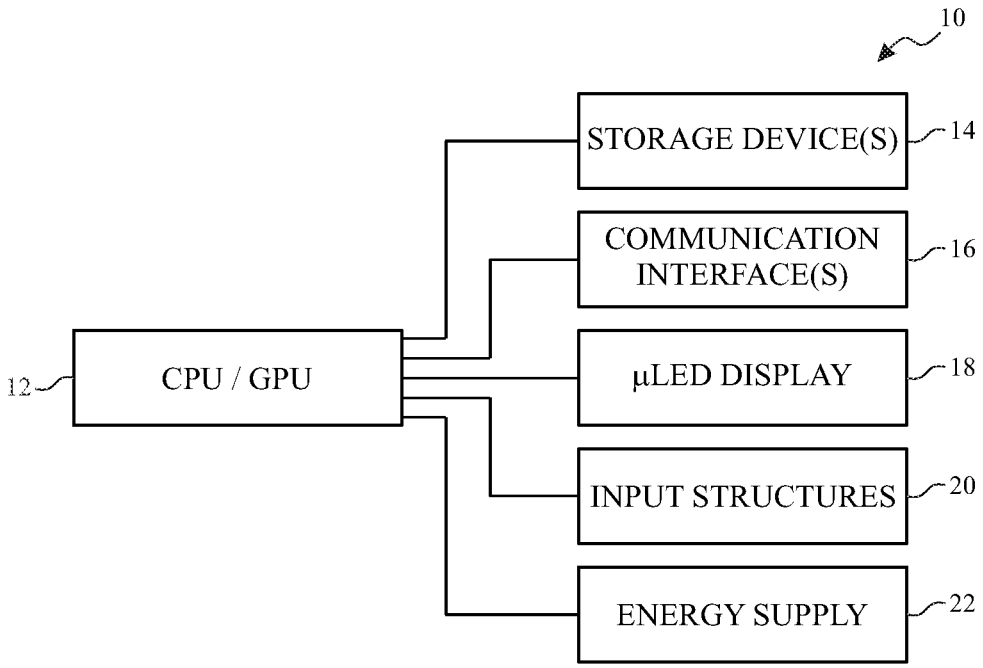
FIG. 1 is a block diagram of components of an electronic device that may include a micro-light-emitting-diode (μ-LED) display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, μLED displays utilize display technologies that are superior to LCD and OLED displays in many ways. Nevertheless, because this approach relies upon pick-and-place and bonding technologies, the fabrication of μLED displays is prone to certain placement and bonding imperfections. Hence, current μLED displays are manufactured with redundant μLEDs, redundant μDs, and redundant column and row drivers, which then must be tested to determine if any defective elements exist. If so, some of the redundant components are activated and utilized. Unfortunately, known testing techniques require that all known components of the μLED display, including the μLEDs, μDs, and row and column drivers, be fabricated onto the display panel before any testing occurs. As a result, the cost of any unused components unnecessarily leads to additional cost of the μLED display. Furthermore, known testing techniques are performed in a serial fashion and, thus, can only identify whether a row under test includes a defective μD, but cannot pinpoint which μD is defective.

The present techniques described below are capable of identifying and pinpointing defective μDs and row/column drivers either before or after any μLEDs have been placed on the display. Using the architectures described below, the data line of the μLEDs, which is a unidirectional digital line in digital displays used for the transfer of RGB gray levels and driver configuration bits, may be a bidirectional digital line with an additional function of transferring the test output sequences upstream to the timing control (TCON) and/or into the main board. This upstream data flow can include information about the pin connectivity and the functional state of the μDs. Such data collection is a relatively fast process, since the test data is collected from all the μDs in the row under test in a parallel manner. As such, this yields access to the output of every μD in the active row, thus enabling the identification of specific defective μDs. Furthermore, the data lines may not only carry information about pin connectivity and functional state of the μDs, they may also contain information about the pin connectivity and function state of the active row driver in the row driver under test. As a result, the present techniques enable the detection and identification of specific defective row drivers as well.

Suitable electronic devices that may include a micro-LED (μ-LED) display and corresponding circuitry of this disclosure are discussed below with reference to FIGS. 1-4. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a long-term evolution (LTE) cellular network.

Using pixels containing an arrangement μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

Figure 2:
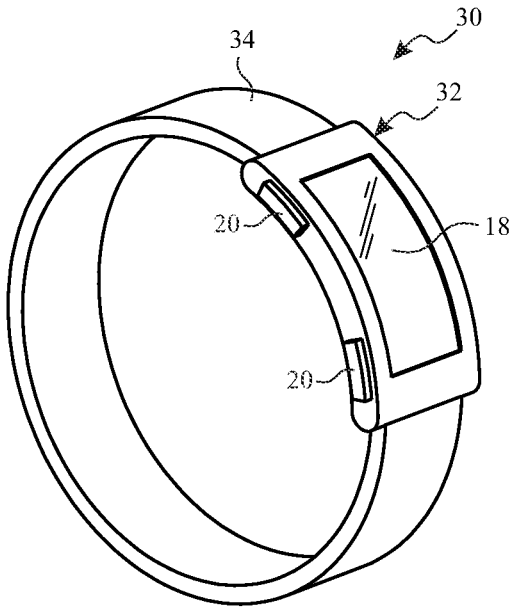
FIG. 2 is a perspective view of the electronic device in the form of a fitness band, in accordance with an embodiment.
Figure 3:
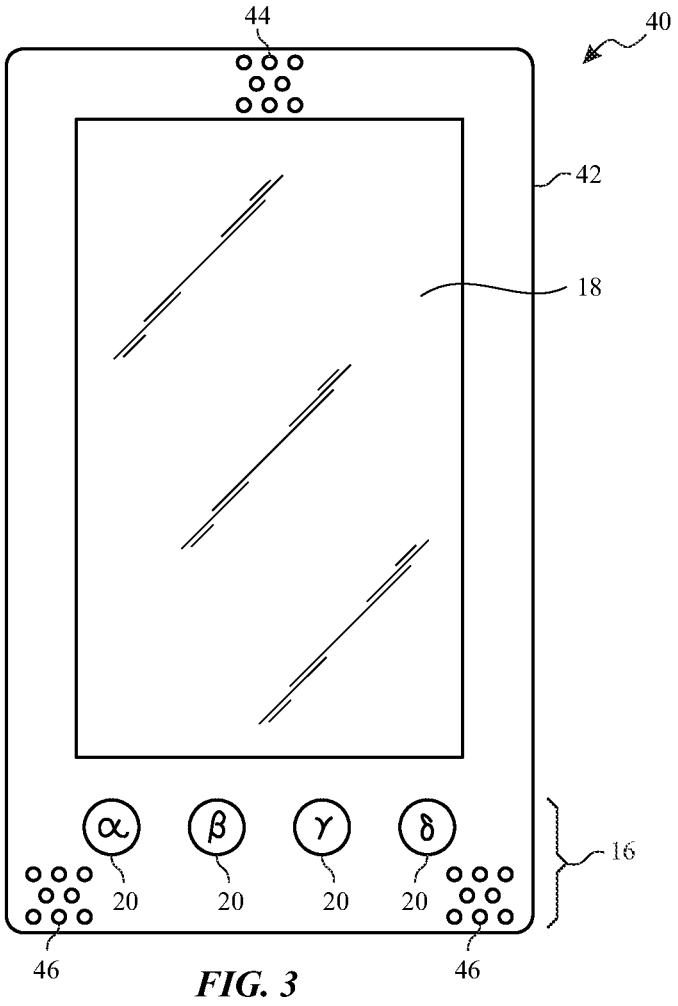
FIG. 3 is a front view of the electronic device in the form of a slate, in accordance with an embodiment.
Figure 4:
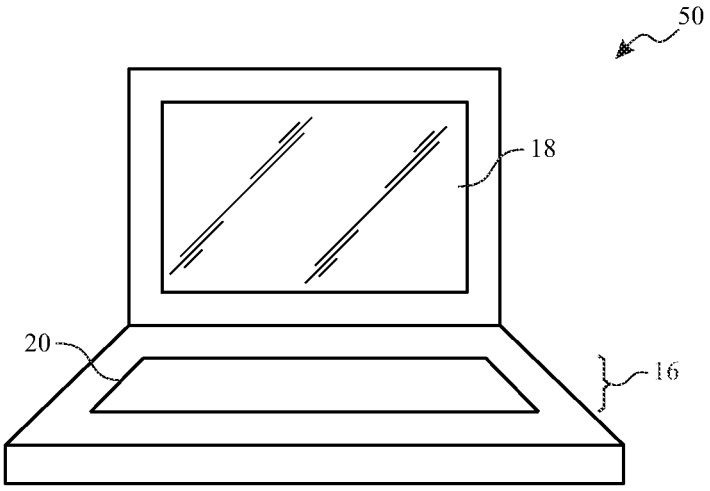
FIG. 4 is a perspective view of the electronic device in the form of a notebook computer, in accordance with an embodiment.

As may be appreciated, the electronic device 10 may take a number of different forms. As shown in FIG. 2, the electronic device 10 may take the form of a wearable electronic device, such as a fitness band 30. The fitness band 30 may include an enclosure 32 that houses the electronic device 10 components of the fitness band 30. A strap 30 may allow the fitness band 34 to be worn on the arm or wrist. The display 18 may display information related to the fitness band operation. Additionally or alternatively, the fitness band 30 may operate as a watch, in which case the display 18 may display the time. Input structures 20 may allow a person wearing the fitness band 30 navigate a graphical user interface (GUI) on the display 18.

The electronic device 10 may also take the form of a slate 40. Depending on the size of the slate 40, the slate 40 may serve as a handheld device such as a mobile phone. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired or wireless connection to another electronic device.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal serial bus (USB) connection.

Figure 5:
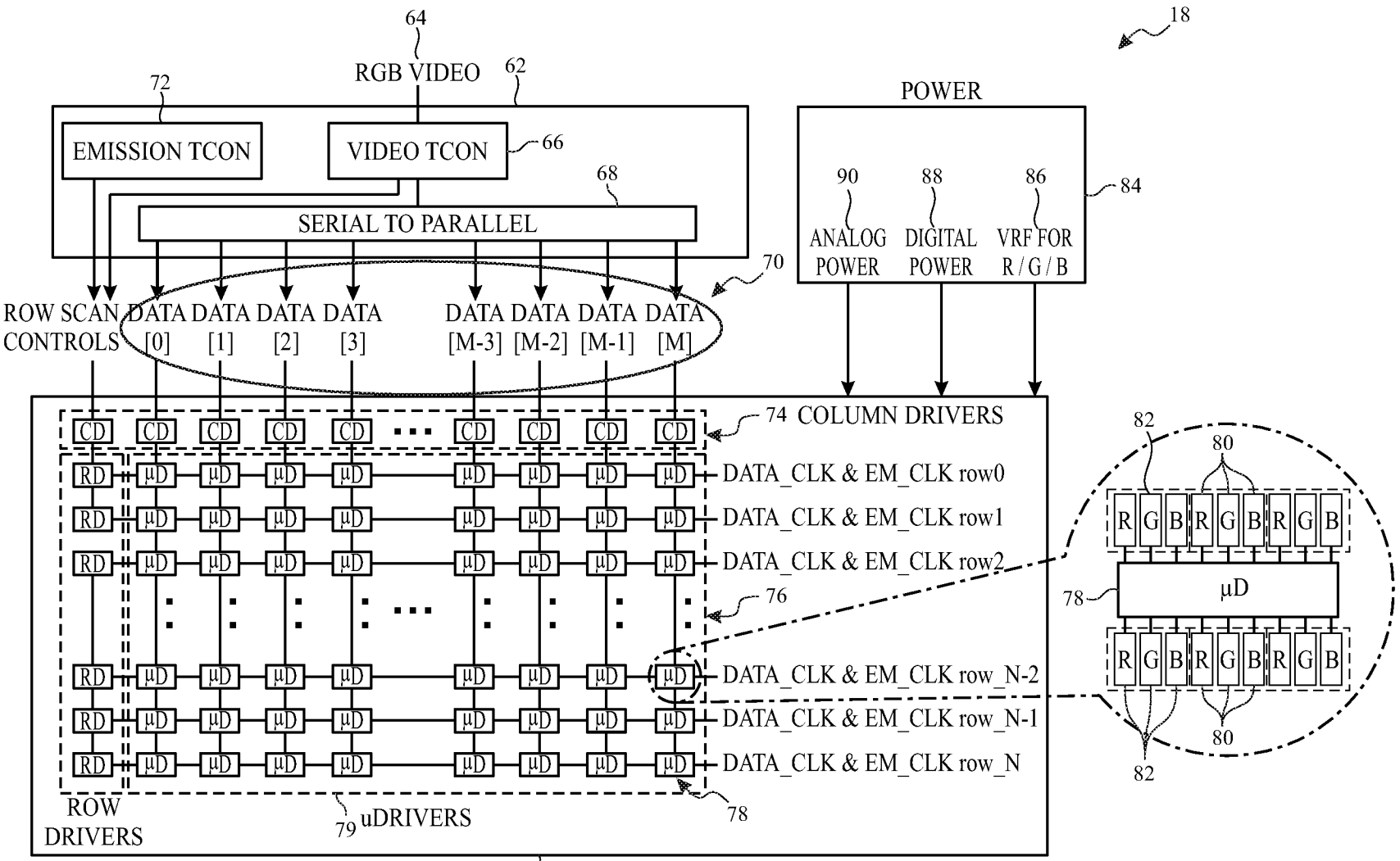
FIG. 5 is a block diagram of μ-LED display that employs micro-drivers (μDs) to drive μ-LED subpixels with controls signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as subpixels. Support circuitry 62 may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial signal to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[0], DATA[1], DATA[2], DATA[3] . . . DATA [M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 includes column drivers (CDs) 74, row drivers (RDs) 76, and micro-drivers (μDs or uDs) 78. The uDs 78 are arranged in an array 79. Each uD 78 drives a number of pixels 80 having μ-LEDs as subpixels 82. Each pixel 80 includes at least one red μ-LED, at least one green μ-LED, and at least one blue μ-LED to represent the image data 64 in RGB format. Although the uDs 78 of FIG. 5 is shown to drive six pixels 80 having three subpixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage (VREF) 86 to drive the μ-LEDs, a digital power signal 88, and an analog power signal 90. In some cases, the power supply 84 may provide more than one reference voltage (VREF) 86 signal. Namely, subpixels 82 of different colors may be driven using different reference voltages. As such, the power supply 84 may provide more than one reference voltage (VREF) 86. Additionally or alternatively, other circuitry on the display panel 60 may step the reference voltage (VREF) 86 up or down to obtain different reference voltages to drive different colors of μ-LED.

To allow the μDs 78 to drive the μ-LED subpixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate to activate the row of μDs 78 driven by the RD 76. A row of uDs 78 may be activated when the RD 76 that controls that row sends the data clock signal (DATA_CLK). This may cause the now-activated uDs 78 of that row to receive and store the digital image data 70 signal that is driven by the column drivers (CDs) 74. The uDs 78 of that row then may drive the pixels 80 based on the stored digital image data 70 signal based on the emission clock signal (EM_CLK).

Figure 6:
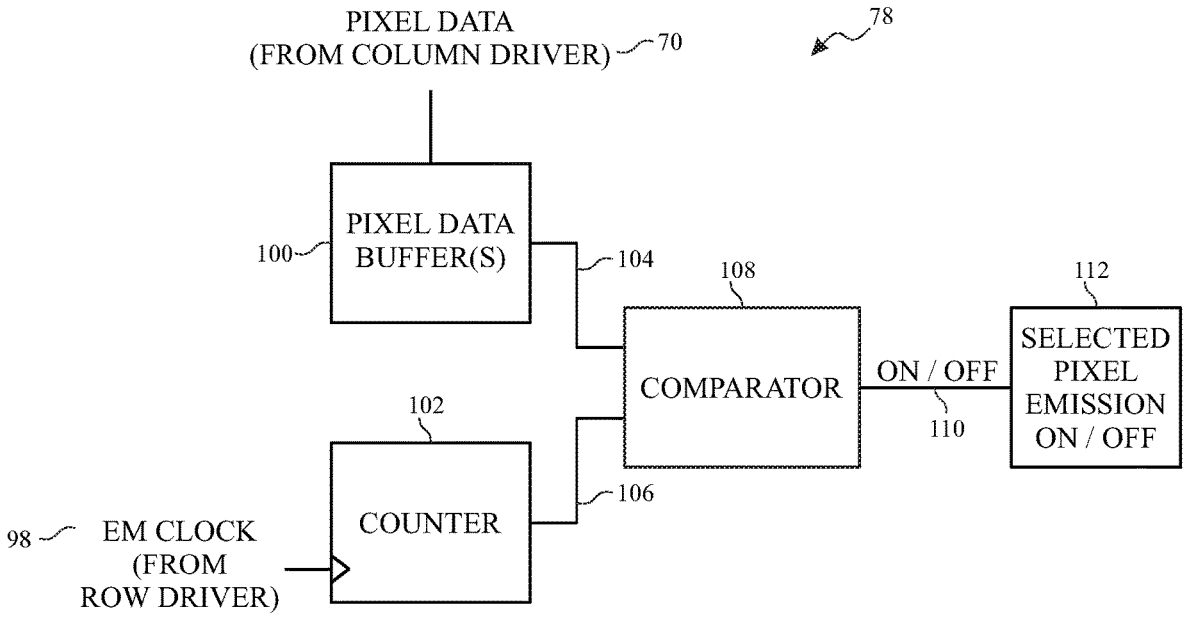
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include pixel data buffers to store image data 70 for three subpixels 82 at any one time (e.g., for 8-bit image data 70, this may be 24 bits of storage). It should be appreciated, however, that the μD 78 may include more or fewer buffers, depending on the data rate of the image data 70 and the number of subpixels 82 included in the image data 70. The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular subpixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the subpixel 82 being driven, which may cause light emission 112 from the selected subpixel 82 to be on or off. The longer the selected subpixel 82 is driven "on" by the emission control signal 110, the greater the amount of light that will be perceived by the human eye as originating from the subpixel 82.

Figure 7:
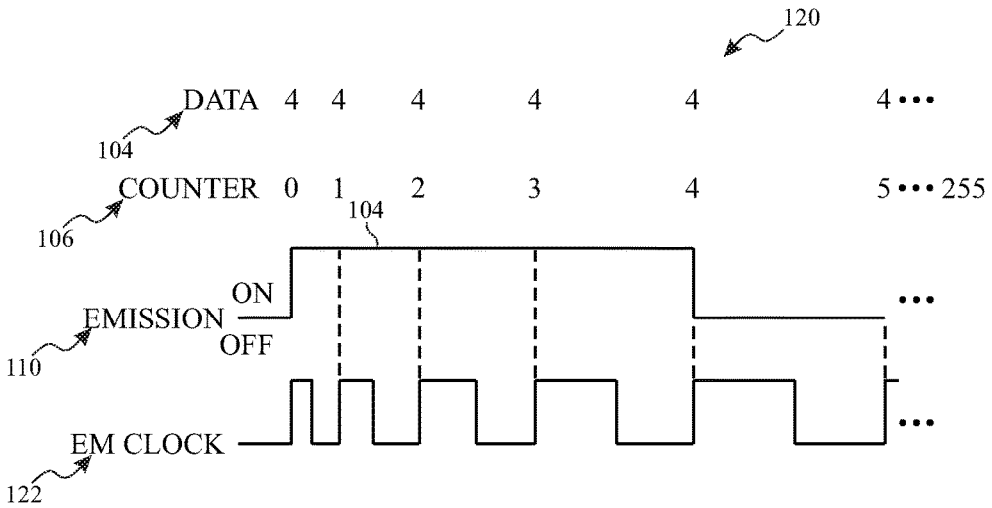
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected subpixel 82 is gray level 4, and this is reflected in the digital data signal 104. The emission control signal 110 drives the subpixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected subpixel 82 no longer to emit light.

It should be noted that the steps between gray levels are reflected by the steps between emission clock signal (EM_CLK) edges. That is, based on the way humans perceive light, to notice the difference between lower gray levels, the difference between the amounts of light emitted between two lower gray levels may be relatively small. To notice the difference between higher gray levels, however, the difference between the amounts of light emitted between two higher gray levels may be comparatively much greater. The emission clock signal (EM_CLK) therefore may use relatively short time intervals between clock edges at first. To account for the increase in the difference between light emitted as gray levels increase, the differences between edges (e.g., periods) of the emission clock signal (EM_CLK) may gradually lengthen. The particular pattern of the emission clock signal (EM_CLK), as generated by the emission TCON 72, may have increasingly longer differences between edges (e.g., periods) so as to provide a gamma encoding of the gray level of the subpixel 82 being driven.

Figure 8:
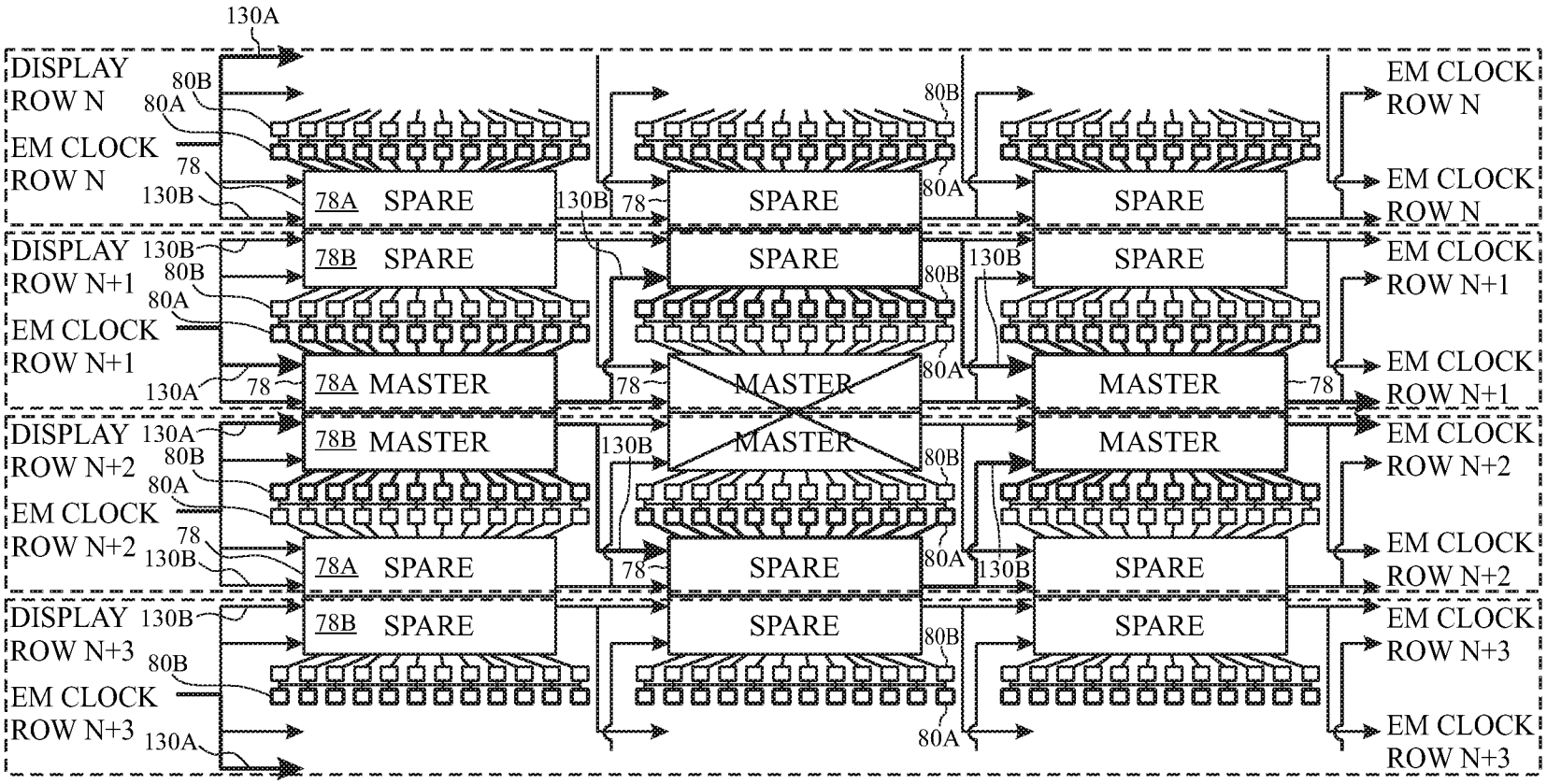
FIG. 8 is a detailed view a section of a μD array illustrating an example of an emission clock distribution and redundancy scheme.

It should be appreciated that since each μD 78 is a small integrated circuit that is typically placed on the display panel 60 by a pick-and-place machine so that it can make the appropriate connections with the plurality of sub-pixels 82 which are similarly placed on the display panel 60. Occasionally, some of the μDs 78 do not function properly. Hence, as illustrated in FIG. 8, each μD 78 may include a pair of μD circuits 78A and 78B, each of which is configured to drive a separate set of pixels 80A and 80B, respectively. As shown in FIG. 8, the μD 78 may be arranged such that one row of μDs 78 may be designated as the primary or master drivers, while alternating rows may be designated as secondary or spare drivers that would typically only be used if the primary or master driver failed. The separate sets of pixels 80A and 80B may be arranged adjacent to one another so that if the master μD 78 fails and cannot drive its set of pixels 80A, the spare μD 78 may be used to drive the set of pixels 80B. Because the separate sets of pixels 80A and 80B are located adjacent to one another, the human eye cannot discern that there is any ambiguity in the image that is produced.

However, as mentioned above, while this redundancy scheme ultimately facilitates the production of a fully functional μLED display 18, any unused components, particularly redundant μLED pixels 80, unnecessarily increase the cost of the μLED display 18. The various testing techniques described below may be performed on the panel 18 prior to the placement and bonding of any of the μLEDs 80. Furthermore, the testing techniques described below are capable of pinpointing specific defective elements, such as defective μDs 78 and defective row drivers 76. Once the defective row drivers 76 and μDs 78 are detected, the μLED pixels 80 may be placed and bonded only on functional μDs 78 in rows that do not include a defective row driver 76. Indeed, as described in greater detail below, because the present testing techniques utilize a parallel as opposed to a serial testing architecture, not only are the present testing techniques capable of pinpointing specific defective row drivers 76 and μDs 78, they also require fewer test pins, thus leading to an overall reduction in pin count on the backplane of the display panel 18.

Figure 9:
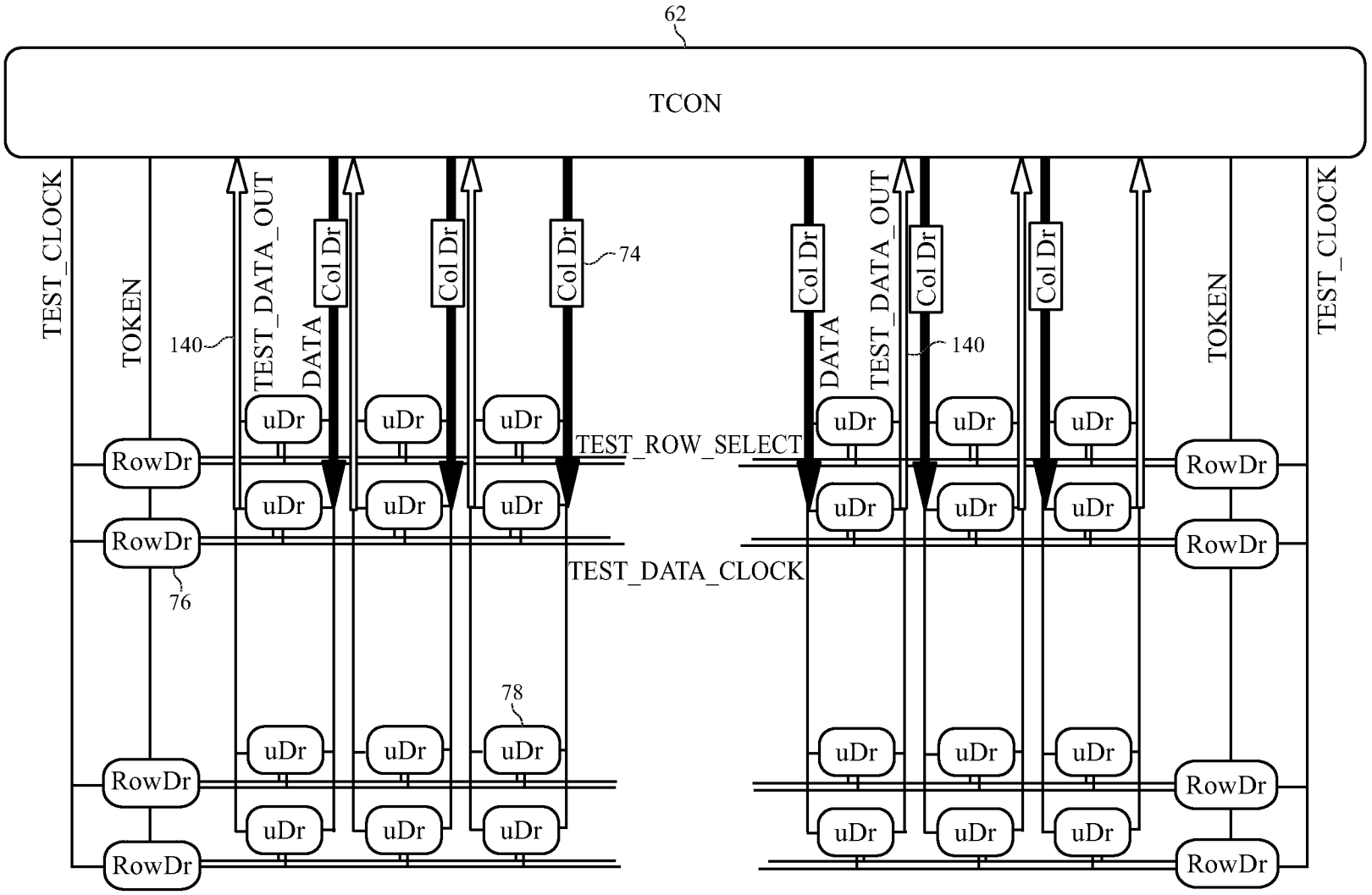
FIG. 9 illustrates a portion of μD array utilizing an embodiment of a testing technique.

A first example of one of these testing techniques and the associated architecture is illustrated in FIG. 9. It should be appreciated that while only a portion of the μD array is illustrated, the present techniques apply to the entire array. In this testing technique, test clock signals are delivered from the support circuitry 62 to the row drivers 76. Each row under test is selected by a token, or row select signal, delivered to the row drivers 76. For each row under test, the column driver 74 simultaneously delivers test data to each of the μDs 78 in that row. The test data is output from each μD 78 back to the support circuitry 62 via the test paths 140. The support circuitry 62 and/or the main board (not shown) processes the received data to determine whether each of the μDs 78 in the active row is functional or defective. For example, each μD 78 in a given row may receive its own test data so that each defective μD 78 can be individually detected. For instance, each test data input/output may be DFT patterns generated by the support circuitry 62.

Figure 10:
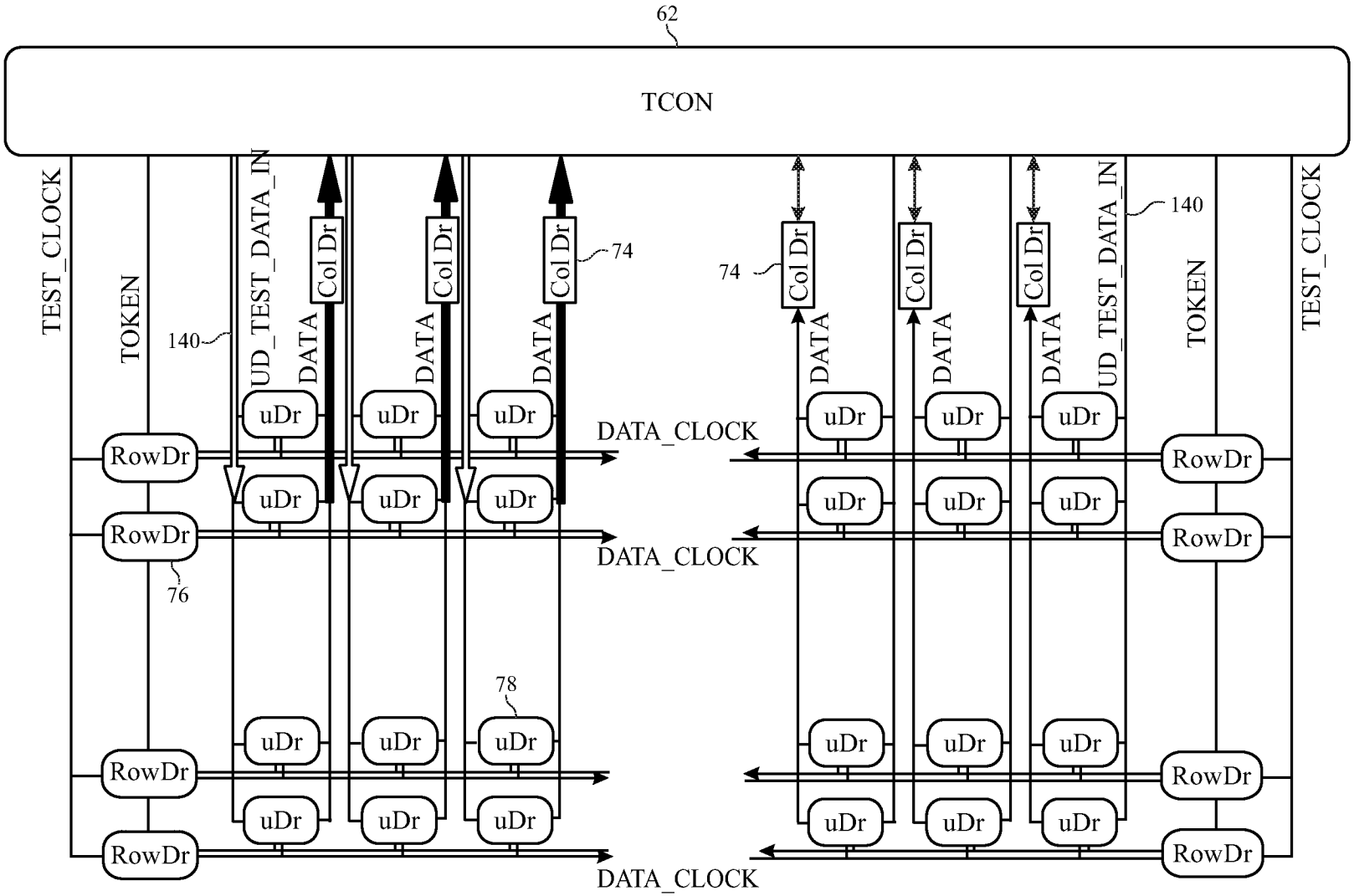
FIG. 10 illustrates a portion of a μD array utilizing a second embodiment of a testing technique.

A second example of a testing technique and its related architecture is illustrated in FIG. 10. It should be appreciated that while only a portion of the μD array is illustrated, the present techniques apply to the entire array. In this testing technique, test clock signals are delivered from the support circuitry 62 to the row drivers 76. Each row under test is selected by a token, or row select signal, delivered to the row drivers 76. For each row under test, the test path 140 simultaneously delivers test data to each of the μDs 78 in that row. The test data is output from each μD 78 back to the support circuitry 62 via the column driver 74. The support circuitry 62 and/or the main board (not shown) processes the received data to determine whether each of the μDs 78 in the active row is functional or defective.

Figure 11:
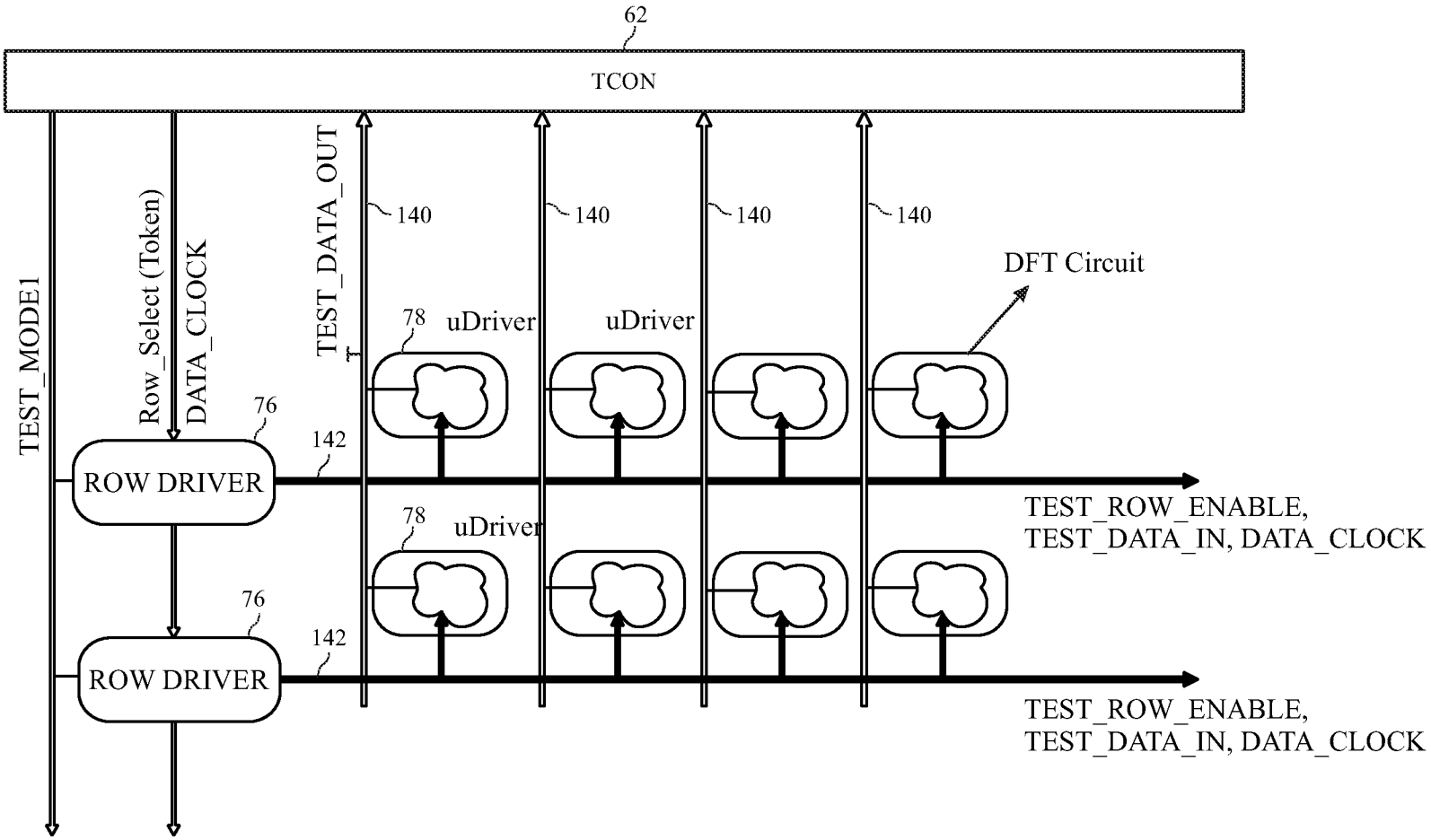
FIG. 11 illustrates a portion of μD array utilizing a third embodiment of a testing technique.

An example of third testing technique and its associated architecture is illustrated in FIG. 11. In this example, the test data, along with the row select (token) and data clock are fed to the row drivers 76 by the support circuitry 62. Each row driver 76 transmits these signals to the μDs 78 in each respective row under test via the row lines 142. The μDs 78 process the input test data and output test data to the support circuitry 62 via the test data output lines 140.

Regardless of which parallel testing technique is used, the support circuitry 62 and/or the processing circuitry coupled to the support circuitry 62 can determine which μDs 78 are defective. Once all of the rows have been tested, the data relating to the defective μDs 78 may be used to determine where to place μLEDs 80 so that they are placed and coupled only to non-defective μDs 78. This reduces the number of μLEDs 80 on the display 18 and, thus, reduces the overall cost of the display 18. Of course, if the μLEDs 80 were already placed and coupled to the respective μDs 78 prior to the testing, the data relating to the defective μDs 78 may be used to determine which portions of the array to use and which to disable due to the presence of defective elements.

Figure 12:
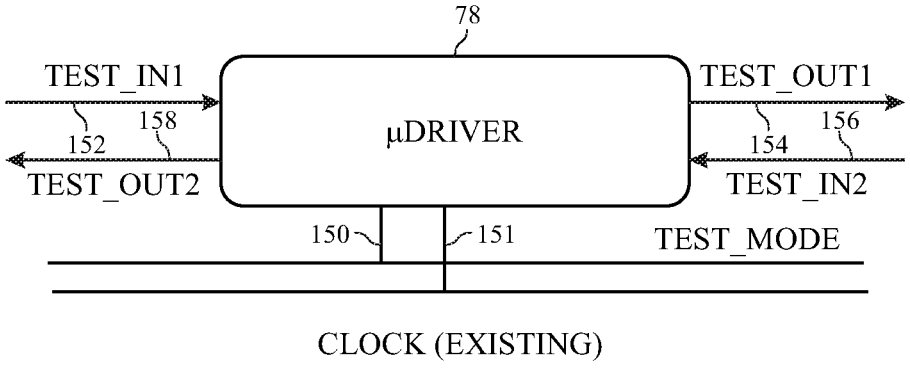
FIG. 12 illustrates a pin-out of a μD using previous testing techniques.
Figure 13:
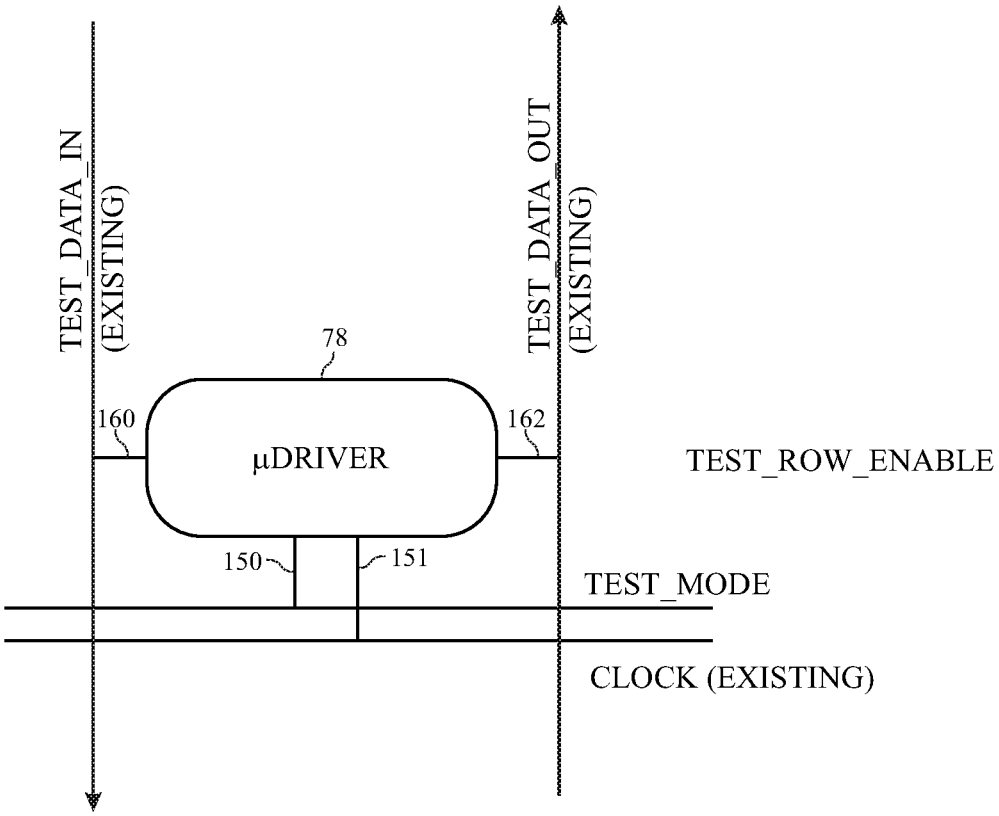
FIG. 13 illustrates an example of a pin-out of a μD using presently disclosed testing techniques.

The testing techniques that utilize the parallel architectures described above require fewer pins than the previous techniques that utilized a serial architecture. An example of such differences may be demonstrated by a comparison by the μD 78 having a serial testing architecture, as illustrated in FIG. 12, with the μD 78 having a parallel architecture, as illustrated in FIG. 13. Referring first to the μD 78 having the serial architecture, it can be seen that it includes five test pins. The test mode pin 150 places the μD 78 into or out of the test mode, and the clock signal is delivered on pin 151. The test_in1 pin 152 delivers test data from a row driver 76 or from the immediately upstream μD 78 to the μD 78. While the test_out1 pin 154 retransmits the test data to the next sequential μD 78. Similarly, the test_in2 pin 156 delivers test data from the immediately downstream μD 78 to the μD 78, while the test_out2 pin 158 delivers the test data to the next upstream μD 78. As mentioned above, when using such a serial testing technique and architecture, the test data properly traverses every μD 78 in a row under test and returns the test data to the respective row driver 76 only if the row driver 76 and all μD 78 in the row under test are functional. If the test data is not returned, this indicates that either the particular row driver 76 or at least one of the μDs 78 in the row under test is defective. However, the exact defective device cannot be pinpointed using this type of serial testing technique.

Conversely, referring now to the row driver 76 having a parallel architecture as illustrated in FIG. 13, it can be seen that it uses only three test pins. In addition to the test mode pin 150 and the clock pin 151, the row driver 78 includes a test_data_in pin 160 and a test_data_out pin 162. Since existing data lines and column drivers may be used for this purpose, the pins 160 and 162 may already be present in the row driver architecture and may simply be reconfigurable depending upon whether the row driver 76 is in the test mode or in the normal operation mode. There may be thousands of μD 78 on each display panel 18, so the display panel 18 may use significantly fewer pins with a parallel testing architecture as compared to a serial testing architecture.

Figure 14:
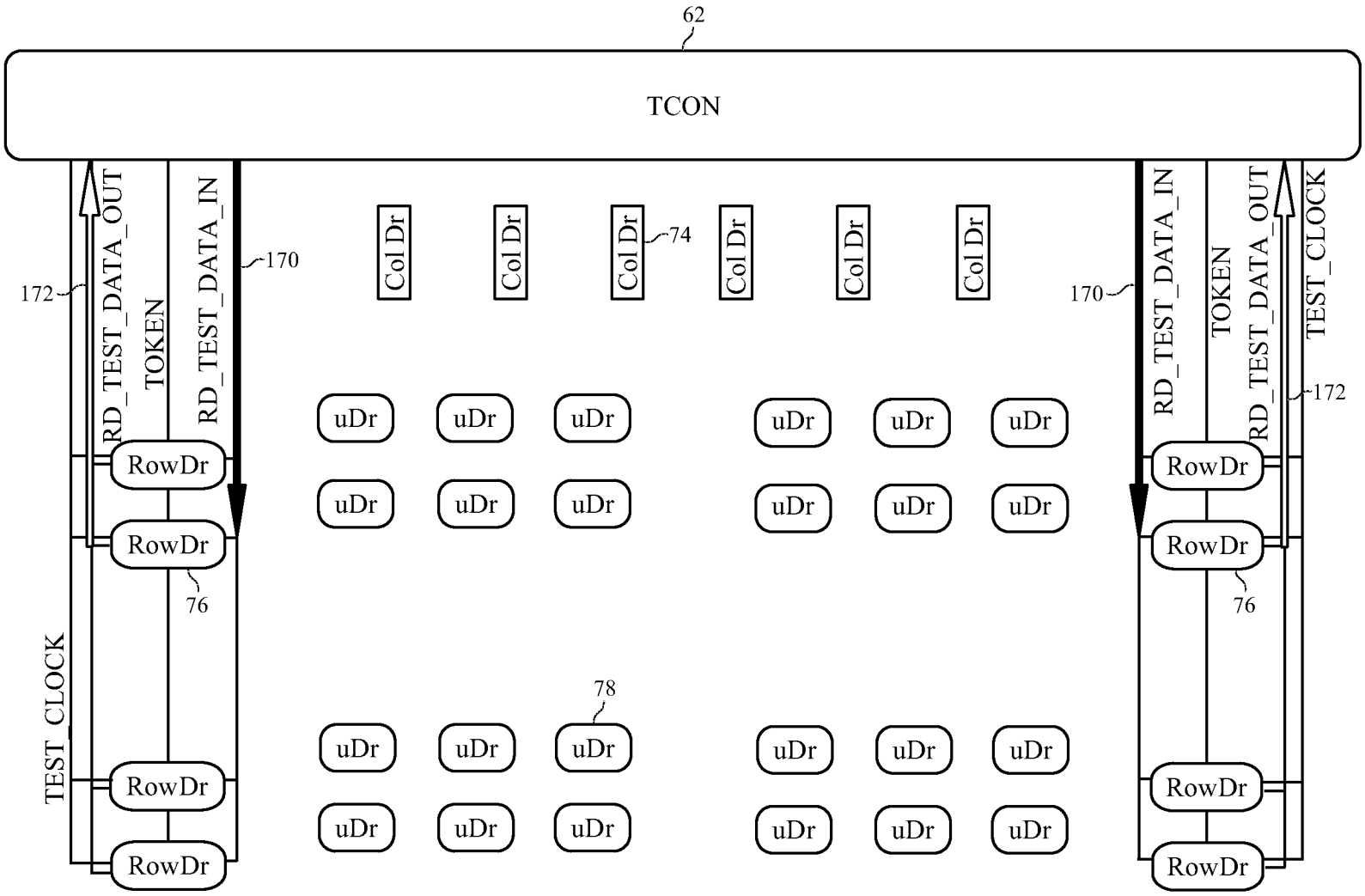
FIG. 14 illustrates a portion of μD array utilizing an embodiment of a testing technique for row drivers.

While the testing techniques described above have been directed toward testing μD 78, it should be appreciated that similar testing techniques may be used to test the row drivers 76 or the column driver 74. An example, of a first technique for testing the row drivers 76 along with its associate architecture is illustrated in FIG. 14. Here, each row driver 76 may be tested sequentially using the row select (token) signal. For each row driver under test, the row driver test data is input via a test data input line 170 from the support circuitry 62. Once the row driver 76 under test processes the test data, it outputs the test data onto a test data output line 172 for delivery back to the support circuitry 62 for further processing to determine whether the row driver 76 is functional or defective.

Figure 15:
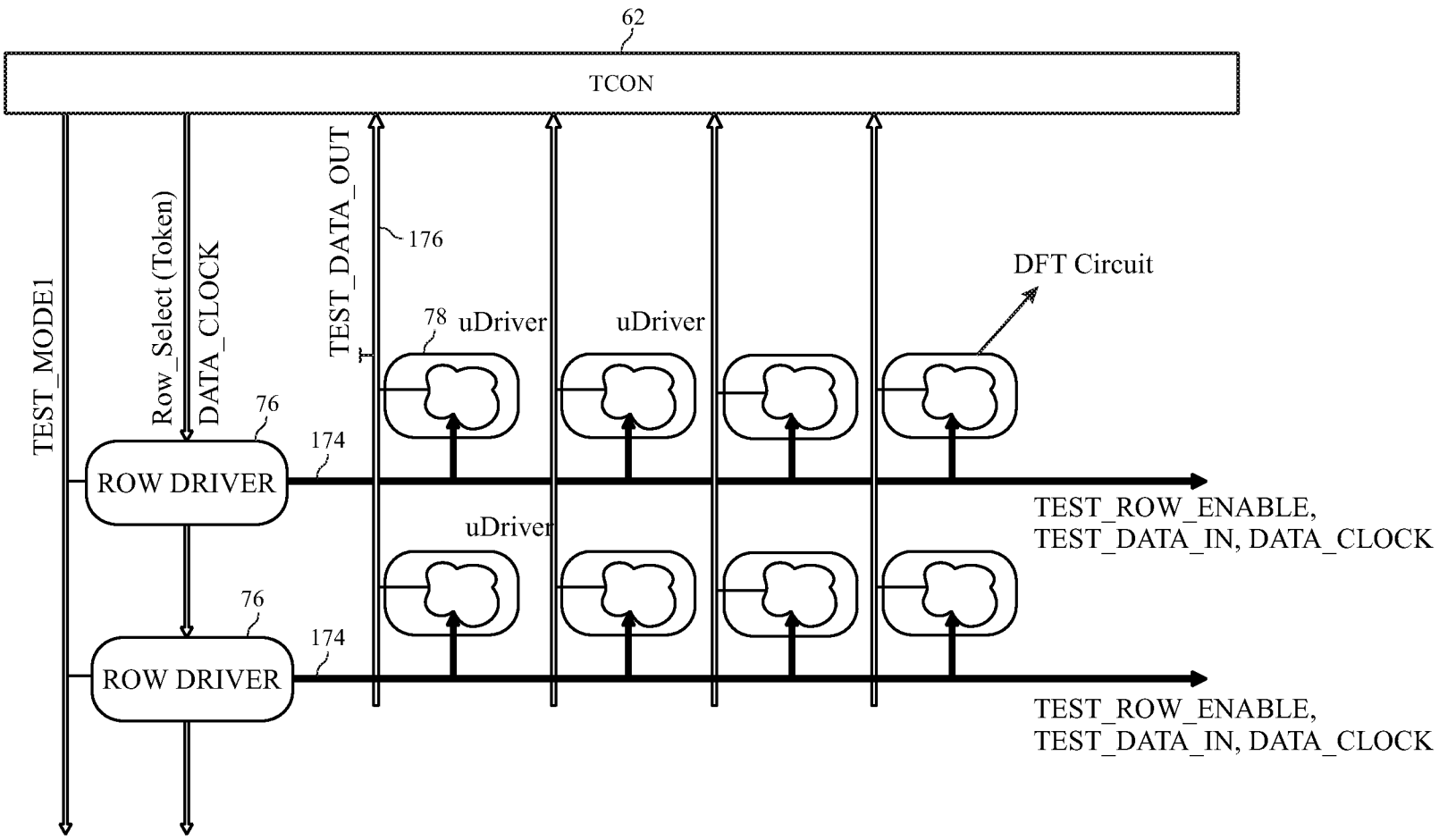
FIG. 15 illustrates a portion of a μD array utilizing a second embodiment of a testing technique for row drivers.

An example of a second testing technique for row driver 76 and the corresponding architecture is illustrated in FIG. 15. In this example, similar to the example set forth in FIG. 11, the support circuitry 62 delivers the row select (token) signal along with a data clock to the row drivers 76. The test data is fed to each row driver 76 under test in a parallel fashion on line 174. The row driver 76 outputs the test data on the line 174 to the μD 78, which delivers the test data on the test data output line 176 so that it can be transmitted to the support circuitry 62 for further processing to determine whether the row driver 76 under test is functional or defective.

Figure 16:
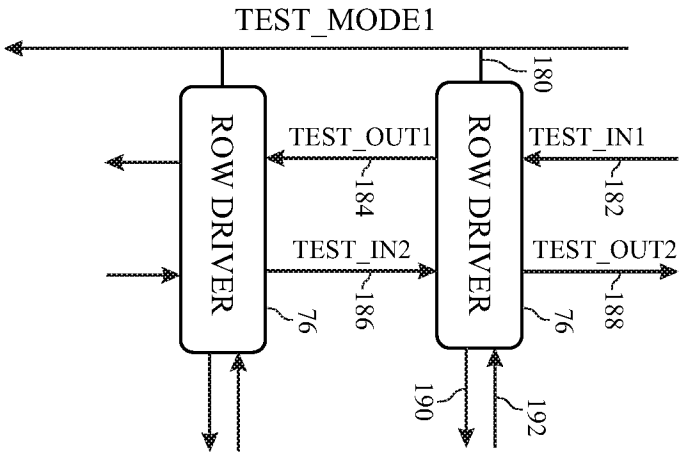
FIG. 16 illustrates a pin-out of row drivers using previous testing techniques.

As with the serial versus parallel μD 78 discussed above, providing a parallel testing technique and architecture for the row drivers 76 as compared to a serial testing technique and architecture requires fewer testing pins. An example of such differences can be seen by a comparison of the serial testing architecture for row driver 76 illustrated in FIG. 16 versus the parallel testing architecture for row driver 76 illustrated in FIG. 17. Referring first to the serial architecture illustrated in FIG. 16, it can be seen that seven test pins are used. The test mode signal is delivered to each row driver 76 on a pin 180 to place the row driver 76 into a test mode. Test input data is delivered to the row driver 76 on a test_in1 pin 182, and each row driver 76 delivers the test data to the next sequential row driver 76 on a test_out1 pin 184. Once the test data has been delivered to all of the row drivers 76 in the row, the test data is delivered back up the chain via a test_in2 pin 186 and via a test_out2 pin 188 until the test data again reaches the support circuitry 62. The test data is delivered in a serial fashion to each μD 78 in a row and returned via lines 190 and 192.

Figure 17:
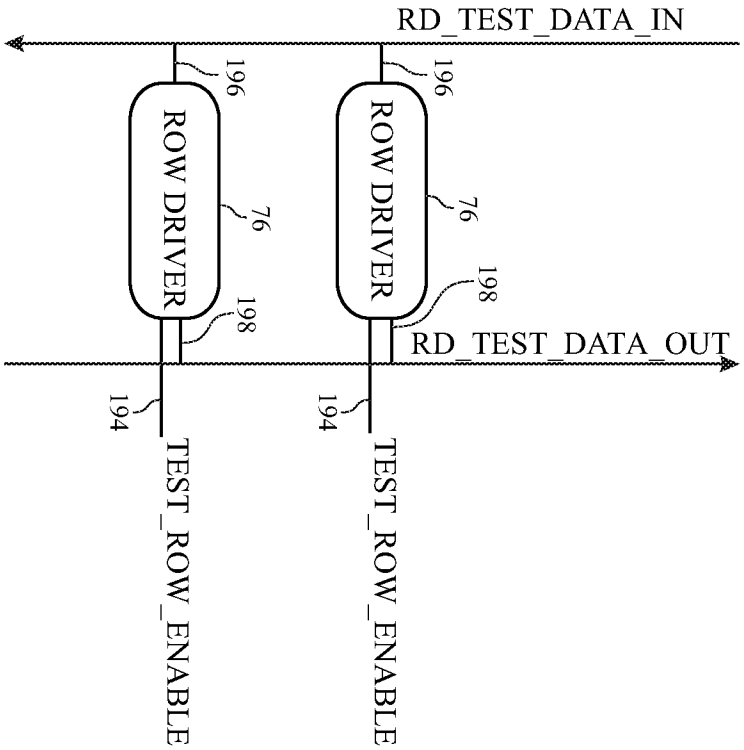
FIG. 17 illustrates an example of a pin-out of row drivers using presently disclosed testing techniques.

In comparison with the serial testing architecture, the parallel testing architecture in FIG. 17 uses only three pins per row driver 76. Each row driver 76 under test is sequentially selected using the test row enable signal delivered on the pin 194. The test data is delivered to each row driver 76 on a test data in pin 196, and the test data is transmitted from each row driver 76 on a test data out pin 198. Because each row driver 76 uses only three pins in a parallel testing architecture as opposed to seven pins in a serial testing architecture, and because of hundreds of row drivers can be on a single display panel 18, the parallel testing architecture offers significantly fewer pins as compared to the serial testing architecture.

Figure 18:
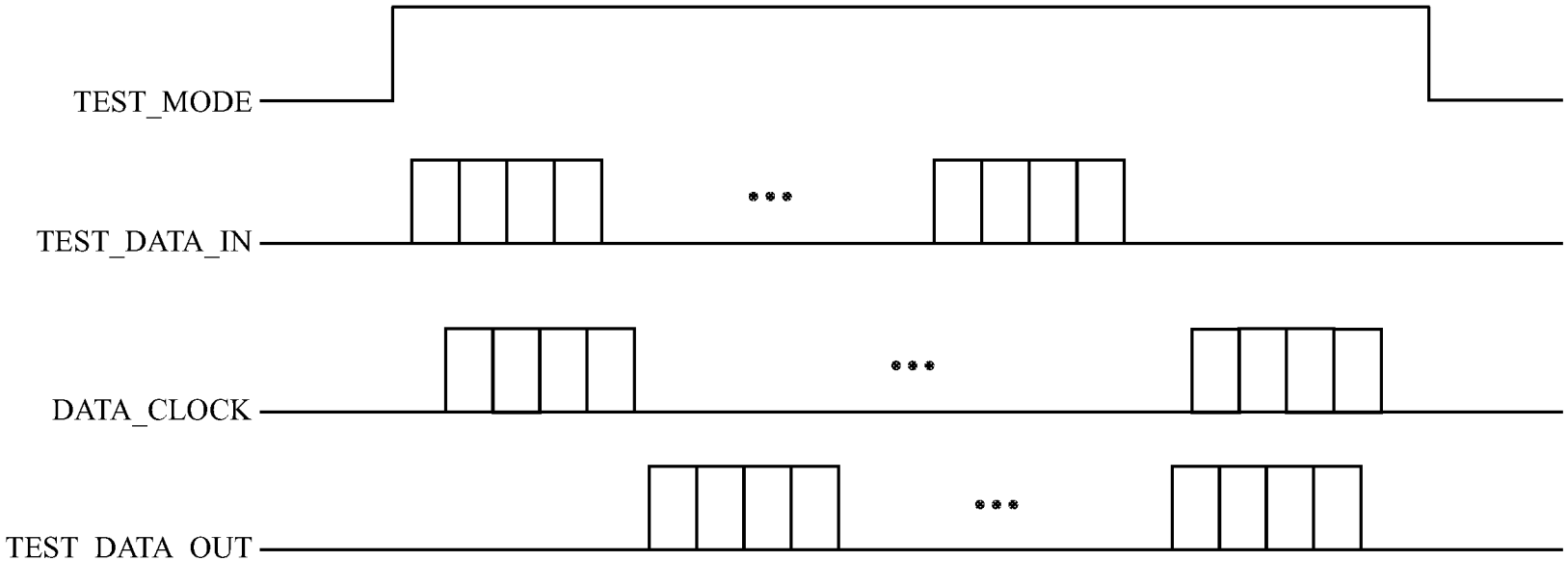
FIG. 18 illustrates an example of test timing signals for μDs using present testing techniques.

FIG. 18 illustrates examples of the various test signals that may be used in the above testing techniques for the row driver 76 and the μD 78. When the test mode signal is asserted, test data (test data in) may be input to the enabled row driver 76 or μD 78, and test data (test data out) may be output from the row driver 76 or the μDs 78. Both the input test data and the output test data may be clocked in and out via the data clock.

Figure 19:
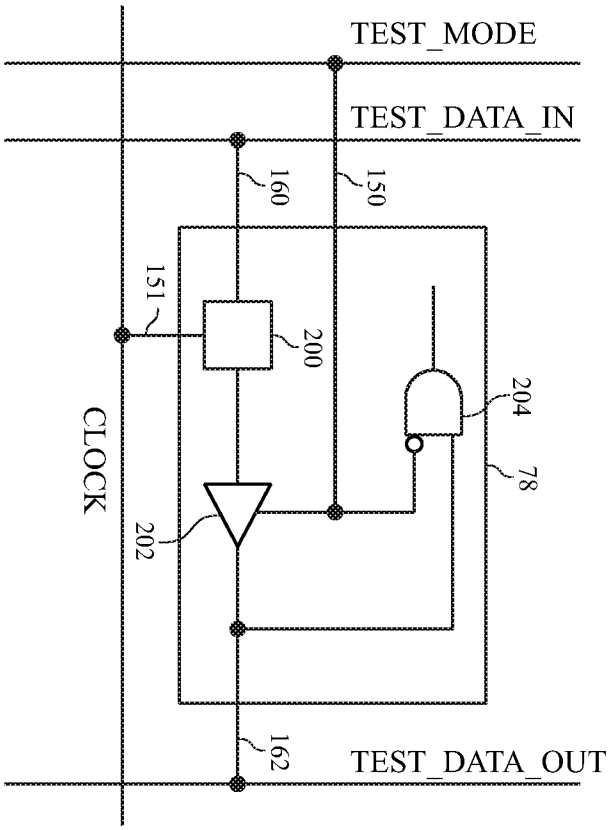
FIG. 19 illustrates a detailed block diagram of a μD using present testing techniques.

For the μDs 78, the internal circuitry may include the circuitry shown by way of example in FIG. 19. As illustrated, the μD 78 may include a return-to-zero modulator 200 that receives the test data in signal on pin 160 and the clock signal on pin 151. The test data in signal is clocked and delivered to tri-state buffer 202. The return-to-zero modulator 200 transfers the logic "1" to the clock pulses to avoid holding high voltage levels at the output of the tri-state buffer 202. The tri-state buffer 202 also receives the test mode signal on its enable input from pin 150 to switch it from normal operational mode into test mode. This enables it to receive the test data from pin 160 and output test data on pin 162. In normal mode, the tri-state buffer 202 switches off so that actual data can be received on pin 162 and processed through AND gate 204.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Moreover, although the foregoing discusses row drivers that send data to microdrivers and column drivers that control which micro driver in a row receives the data, it should be appreciated that the foregoing discussion about row drivers may be applied to column drivers and vice versa merely by rotating orientation of the display. Thus, recitations of columns and rows may be interchangeable in meaning herein.

What is claimed is:

1. A method of testing a display having an array of microdrivers arranged in a plurality of rows and columns, comprising:

(a) selecting a row of microdrivers to be tested;

(b) delivering test data in parallel from support circuitry to each of the microdrivers in the selected row;

(c) transmitting an output in parallel corresponding to the test data from each of the microdrivers in the selected row to the support circuitry; and (d) repeating steps (a) through (c) for each row in the array of microdrivers.

2. The method, as set forth in claim 1, comprising:

(e) determining whether any microdrivers in each selected row are defective based at least in part on the output corresponding to the test data.

3. The method, as set forth in claim 2, wherein the step of determining is performed by the support circuitry.

4. The method, as set forth in claim 3, wherein the support circuitry comprises a timing controller.

5. The method, as set forth in claim 2, wherein the step of determining is performed by a processing circuit coupled to the support circuitry.

6. The method, as set forth in claim 2, wherein the recited steps (a) through (e) are performed prior to disposing any microLEDs on the display.

7. The method, as set forth in claim 6, comprising the step of disposing microLEDs on the display in connection with only non-defective microdrivers.

8. The method, as set forth in claim 2, comprising the step of programming the display to avoid any defective microdrivers.

9. The method, as set forth in claim 7, comprising the step of programming the display to avoid any defective microdrivers.

10. An electronic display comprising:

an array of microdrivers arranged in a plurality of rows and columns; and processing circuitry operably coupled to the array of microdrivers and being configured to:

(a) select a row of microdrivers to be tested;

(b) deliver test data in parallel to each of the microdrivers in the selected row;

(c) receive an output in parallel corresponding to the test data from each of the microdrivers in the selected row; and (d) repeat steps (a) through (c) for each row in the array of microdrivers.

11. The electronic display, as set forth in claim 10, wherein the processing circuitry is configured to:

(e) determine whether any microdrivers in each selected row are defective based at least in part on the output corresponding to the test data.

12. The electronic display, as set forth in claim 10, wherein the processing circuitry comprises a timing controller.

13. The electronic display, as set forth in claim 11, wherein the processing circuitry is configured to perform the recited steps (a) through (e) prior to any microLEDs being disposed on the electronic display.

14. The electronic display, as set forth in claim 11, wherein the processing circuitry is configured to program the display to avoid any defective microdrivers.

15. A method of testing a display having an array of microdrivers arranged in a plurality of rows and columns and having at least one row driver of row drivers coupled to each respective row of microdrivers, comprising:

delivering test data in parallel from support circuitry to the row drivers; and transmitting an output in parallel corresponding to the test data from the row drivers to the support circuitry.

16. The method, as set forth in claim 15, comprising:

determining whether any row drivers are defective based at least in part on the output corresponding to the test data.

17. The method, as set forth in claim 16, wherein the step of determining is performed by the support circuitry.

18. The method, as set forth in claim 17, wherein the support circuitry comprises a timing controller.

19. The method, as set forth in claim 16, wherein the step of determining is performed by a processing circuit coupled to the support circuitry.

20. The method, as set forth in claim 16, wherein the recited steps are performed prior to disposing any microLEDs on the display.

21. The method, as set forth in claim 20, comprising the step of disposing microLEDs on the display in connection with microdrivers in rows that only include non-defective row drivers.

22. The method, as set forth in claim 16, comprising the step of programming the display to avoid any defective row drivers.

23. The method, as set forth in claim 21, comprising the step of programming the display to avoid any defective microdrivers.

24. An electronic display comprising:

an array of microdrivers arranged in a plurality of rows and columns;

at least one row driver of row drivers coupled to each respective row of microdrivers; and processing circuitry operably coupled to the array of microdrivers and the row drivers, the processing circuitry being configured to:

deliver test data in parallel to the row drivers; and receive an output in parallel corresponding to the test data from the row drivers.

25. The electronic display, as set forth in claim 24, wherein the processing circuitry is configured to:

determine whether any row drivers are defective based at least in part on the output corresponding to the test data.

26. The electronic display, as set forth in claim 24, wherein the processing circuitry comprises a timing controller.

27. The electronic display, as set forth in claim 25, wherein the processing circuitry is configured to perform the recited steps prior to any microLEDs being disposed on the electronic display.

28. The electronic display, as set forth in claim 25, wherein the processing circuitry is configured to program the electronic display to avoid any defective row drivers.

* * * * *